US009380851B1

(12) United States Patent
Cretton

(10) Patent No.: US 9,380,851 B1
(45) Date of Patent: Jul. 5, 2016

(54) ARTIFICIAL NAIL HOLDING DEVICE

(71) Applicant: Edward Cretton, Sheboygan, WI (US)

(72) Inventor: Edward Cretton, Sheboygan, WI (US)

( * ) Notice: Subject to any disclaimer, the term of this patent is extended or adjusted under 35 U.S.C. 154(b) by 0 days.

(21) Appl. No.: 14/844,868

(22) Filed: Sep. 3, 2015

(51) Int. Cl.
*A45D 29/00* (2006.01)
*A45D 31/00* (2006.01)

(52) U.S. Cl.
CPC ..... *A45D 29/00* (2013.01); *A45D 31/00* (2013.01)

(58) Field of Classification Search
CPC ..... A45D 29/00; A45D 31/00; A47B 65/00; A47B 73/00; A47F 7/005; A47F 7/02; A47F 7/022; A47F 7/12; A47F 7/24
USPC ..... 211/13.1, 16, 34, 35, 37, 43, 85.2, 85.7, 211/105.1, 123, 124, 204; 206/460
See application file for complete search history.

(56) References Cited

U.S. PATENT DOCUMENTS 529,439 A * 11/1894 Bent ..... A47F 7/08 211/38
543,025 A * 7/1895 Knopf ..... A47F 7/24 211/204
2,020,100 A 11/1935 Boyd
2,134,606 A * 10/1938 Hackworth ..... A47B 65/00 108/27
2,760,500 A 8/1956 Johnson, Jr.
2,940,683 A * 6/1960 Tauber ..... D05C 1/065 211/123
3,997,050 A * 12/1976 Patterson ..... A47F 7/02 206/566
4,206,556 A 6/1980 Sabo et al.
4,298,122 A * 11/1981 Ekelund ..... B65H 75/28 206/227
D328,986 S * 9/1992 Lightfoot ..... D6/407
D342,171 S * 12/1993 McConnell ..... D6/681.2
D353,067 S * 12/1994 Asmar ..... D6/552
5,482,057 A * 1/1996 Bushmaker ..... A45D 31/00 132/73
5,904,149 A * 5/1999 Ruhl ..... A45D 31/00 132/73
6,354,447 B1 * 3/2002 Brown ..... A47F 7/0028 132/73
8,348,067 B2 * 1/2013 Brown ..... A47F 7/0028 132/73
2005/0268931 A1 * 12/2005 Chang ..... A45D 31/00 132/200

* cited by examiner

*Primary Examiner* — Joshua Rodden
(74) *Attorney, Agent, or Firm* — Crossley & Stevenson Intellectual Property Law

(57) ABSTRACT

An artificial nail holding device including a pair of bases, at least one rotatable dowel, and a pair of double-sided adhesive strips. The pair of bases includes a right base and a left base. The at least one rotatable dowel has a right end rotatably disposed within the right base and a left end rotatably disposed within the left base. The pair of double-sided adhesive strips is continuously attached to the at least one dowel from proximal the right end of the dowel to proximal the left end of the dowel.

10 Claims, 3 Drawing Sheets

ARTIFICIAL NAIL HOLDING DEVICE

BACKGROUND OF THE INVENTION

Various types of nail devices are known in the prior art. However, what has been needed is an artificial nail holding device including a pair of bases, at least one rotatable dowel, and a pair of double-sided adhesive strips. What has been further needed is for the at least one rotatable dowel to have a right end rotatably disposed within a right base of the pair of bases and a left end rotatably disposed within a left base of the pair of bases. What has been further needed is for the pair of double-sided adhesive strips to be continuously attached to the at least one dowel from proximal the right end of the dowel to proximal the left end of the dowel so that a plurality of nails can be removably attached to an exterior surface of each of the pair of adhesive strips. The artificial nail holding device thus provides a nail technician and any artificial nail wearer with a convenient and temporary storage mechanism for a plurality of artificial nails.

FIELD OF THE INVENTION

The present invention relates to nail devices, and more particularly, to an artificial nail holding device.

SUMMARY OF THE INVENTION

The general purpose of the present artificial nail holding device, described subsequently in greater detail, is to provide an artificial nail holding device which has many novel features that result in an artificial nail holding device which is not anticipated, rendered obvious, suggested, or even implied by prior art, either alone or in combination thereof.

To accomplish this, the present artificial nail holding device includes a pair of bases including a right base and a left base. Each of the right base and the left base has a top edge and a bottom edge. At least one rotatable dowel has a right end and a left end. The right end of the at least one dowel is rotatably disposed within the right base, and the left end of the at least one dowel is rotatably disposed within the left base. Each of the right end of the at least one dowel and the left end of the at least one dowel is medially disposed between the top edge and the bottom edge of each of the right base and the left base, respectively. Each of the right base and the left base optionally slidably engages each of the right end of the at least one dowel and the left end of the at least one dowel, respectively, thus permitting each of the pair of bases to slide inward and outward along the at least one dowel. A pair of double-sided adhesive strips is continuously attached to the at least one dowel from proximal the right end of the dowel to proximal the left end of the dowel. Each of the pair of adhesive strips is disposed over substantially one half of a surface area of the at least one dowel. A plurality of artificial nails is configured to removably attach to an exterior surface of each of the pair of adhesive strips.

Each of the pair of bases is optionally rectangular, with a length of 1.25 inches. The at least one dowel optionally has a length of 7 inches and, alternately, 10.5 inches. A length of 7 inches and 10.5 inches specifically configures the at least one dowel to hold five artificial nails and ten artificial nails, respectively, on one of the pair of adhesive strips on the dowel.

Thus has been broadly outlined the more important features of the present artificial nail holding device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 5 thereof, an example of the instant artificial nail holding device employing the principles and concepts of the present artificial nail holding device and generally designated by the reference number 10 will be described.

Figure 1:
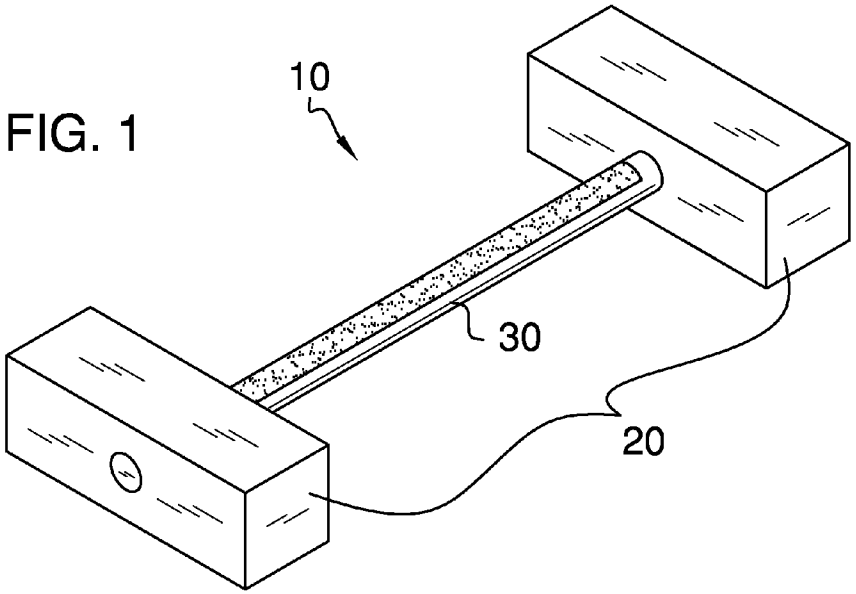
FIG. 1 is a front isometric view a single dowel.
Figure 2:
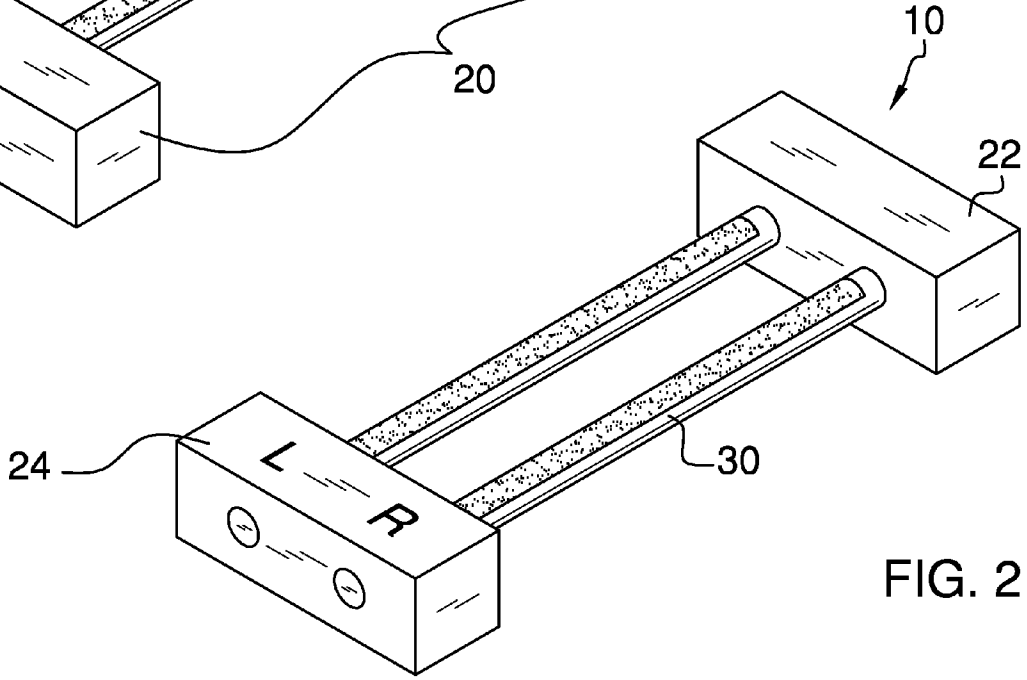
FIG. 2 is a front isometric view showing a pair of dowels.
Figure 3:
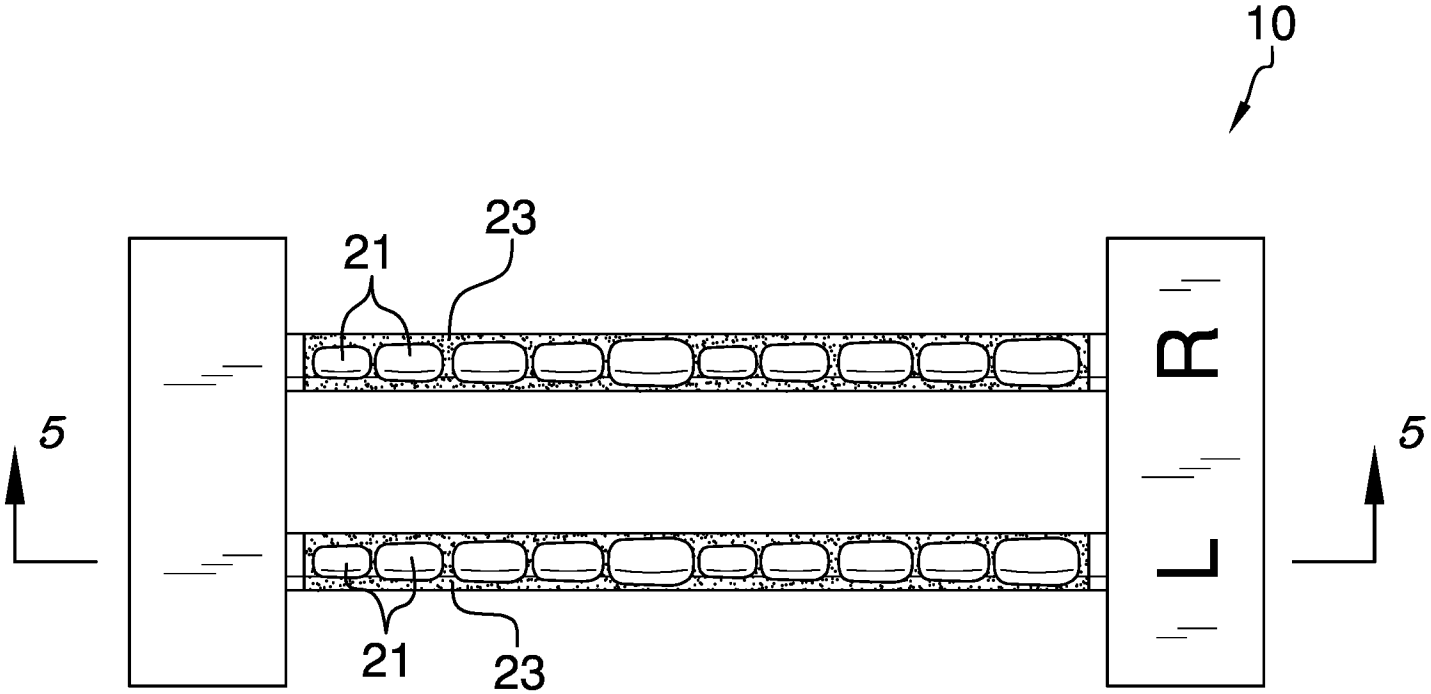
FIG. 3 is a top plan view.
Figure 4:
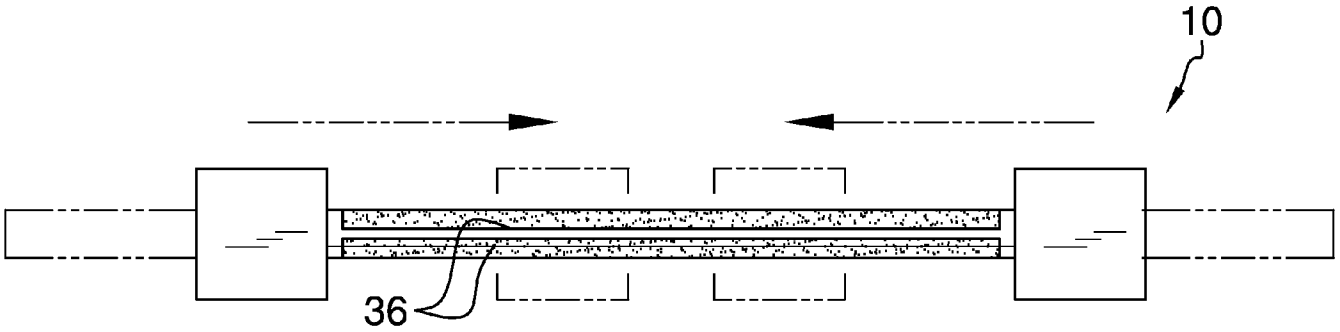
FIG. 4 is a side elevation view showing a pair of bases slidingly engageable with an at least one dowel.
Figure 5:
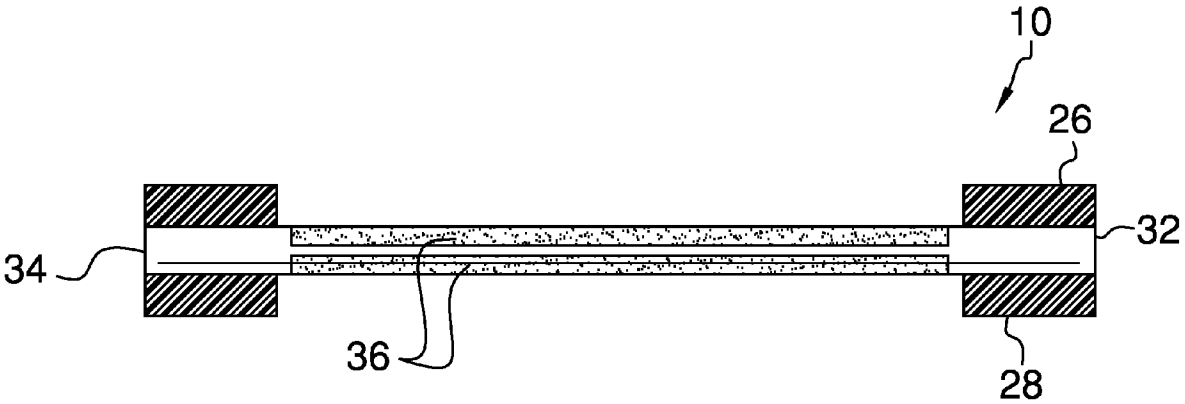
FIG. 5 is a cross-sectional view taken along line 5-5 of FIG. 3.

Referring to FIGS. 1 through 5 the present artificial nail holding device 10 is illustrated. The artificial nail holding device 10 includes a pair of bases 20 including a right base 22 and a left base 24. Each of the right base 22 and the left base 24 has a top edge 26 and a bottom edge 28. At least one rotatable dowel 30 has a right end 32 and a left end 34. The right end 32 of the at least one dowel 30 is rotatably disposed within the right base 22, and the left end 34 of the at least one dowel 30 is rotatably disposed within the left base 24. Each of the right end 32 of the at least one dowel 30 and the left end 34 of the at least one dowel 30 is medially disposed between the top edge 26 and the bottom edge 28 of each of the right base and the left base, respectively. As best shown in FIG. 4, each of the right base 22 and the left base 24 optionally slidably engages each of the right end 32 of the at least one dowel 30 and the left end 34 of the at least one dowel 30, respectively, thus permitting each of the pair of bases 20 to slide inward and outward along the at least one dowel 30. A pair of double-sided adhesive strips 36 is continuously attached to the at least one dowel 30 from proximal the right end 32 of the dowel 30 to proximal the left end 34 of the dowel 30. A plurality of artificial nails 21 is removably attached to an exterior surface 23 of each of the pair of adhesive strips 36.

What is claimed is:

1. An artificial nail holding device comprising:

a pair of bases comprising a right base and a left base, each of the right base and the left base having a top edge and a bottom edge;

at least one rotatable dowel having a right end and a left end, wherein the right end of the at least one dowel is rotatably disposed within the right base, and the left end of the at least one dowel is rotatably disposed within the left base, wherein each of the right end of the at least one dowel and the left end of the at least one dowel is medially disposed between the top edge and the bottom edge of each of the right base and the left base, respectively;

a pair of double-sided adhesive strips continuously attached to the at least one dowel from proximal the right end to proximal the left end, wherein each of the pair of adhesive strips is disposed over substantially one half of a surface area of the at least one dowel;

a plurality of artificial nails removably attached to an exterior surface of each of the pair of adhesive strips.

2. The artificial nail holding device of claim 1 wherein each of the right base and the left base slidably engages each of the right end of the at least one dowel and the left end of the at least one dowel, respectively, wherein each of the pair of bases is configured to slide inward and outward along the at least one dowel.

3. The artificial nail holding device of claim 2 wherein each of the pair of bases is rectangular.

4. The artificial nail holding device of claim 3 wherein each of the pair of bases has a length of 1.25 inches.

5. The artificial nail holding device of claim 4 wherein the at least one dowel has a length of 7 inches.

6. The artificial nail holding device of claim 4 wherein the at least one dowel has a length of 10.5 inches.

7. The artificial nail holding device of claim 1 wherein each of the pair of bases is rectangular.

8. The artificial nail holding device of claim 7 wherein each of the pair of bases has a length of 1.25 inches.

9. The artificial nail holding device of claim 8 wherein the at least one dowel has a length of 7 inches.

10. The artificial nail holding device of claim 8 wherein the at least one dowel has a length of 10.5 inches.

* * * * *